US005184356A

United States Patent [19]

Löf et al.

[11] Patent Number: 5,184,356

[45] Date of Patent: Feb. 9, 1993

[54] SYSTEM FOR AUTOMATICALLY COVERING SWIMMING POOLS AND METHOD THEREFOR

[76] Inventors: George O. G. Löf, 6 Parkway Dr., Englewood, Colo. 80110; Larry O. D. Löf, 2089 S. Logan, Denver, Colo. 80210

[21] Appl. No.: 654,357

[22] Filed: Feb. 12, 1991

[51] Int. Cl.[5] ..... E04H 4/00

[52] U.S. Cl. ..... 4/502; 4/498

[58] Field of Search ..... 9/502; 242/57, 67.1 R, 242/86.52, 74, 76; 126/415, 426; 4/498, 503, 496, 499, 500; 310/88, 66, 68 C

[56] References Cited

U.S. PATENT DOCUMENTS

| | | | |
|---|---|---|---|
| 3,050,743 | 8/1962 | Lamb | 4/502 |
| 3,706,844 | 12/1972 | Besier et al. | 242/188 |
| 3,844,338 | 10/1974 | Hilgemann et al. | 4/493 |
| 4,060,860 | 12/1977 | Lamb | 4/502 |
| 4,858,253 | 8/1989 | Lamb | 4/502 |
| 4,955,092 | 9/1990 | Hagen | 4/502 |

*Primary Examiner*—Henry J. Recla

*Assistant Examiner*—David J. Walczak

*Attorney, Agent, or Firm*—Dorr, Carson, Sloan & Peterson

[57] ABSTRACT

A system for deploying and retrieving a cover over a swimming pool. The cover is wound onto a motor driven reel. A guide spindle aligns the cover onto the reel during the winding process. A spool, also driven by the motor, has a tow rope wound on it. The tow rope is attached through a pulley system and secured to the cover to align the cover over the pool. Torque-limiting clutches on the reel and spool drive shafts compensate for changes in speed of the winding and unwinding of the tow rope and cover by allowing slippage of the drive shafts. An overriding clutch on the spool allows the spool to spin freely so the tow rope can be easily unwound from the spool by the movement of the cover. A friction brake band provides drag on the spool to prevent slack rope from accumulating. A photoelectric sensor detects full deployment and retrieval of the cover and stops the motor. A heating element is also provided to raise the temperature above the dew point to reduce condensation and corrosion in the system.

34 Claims, 4 Drawing Sheets

SYSTEM FOR AUTOMATICALLY COVERING SWIMMING POOLS AND METHOD THEREFOR

BACKGROUND OF THE INVENTION

1. Field of the Invention

This invention relates to the field of automatic covering systems for indoor swimming pools to reduce heat losses.

2. Statement of the Problem

Water within indoor pools evaporates, causing an increase in the humidity in the structure enclosing the pool. Large quantities of energy are required for the pool water to meet evaporation demand and to heat the air required for ventilation and reduction of humidity in uncovered indoor swimming pools.

One solution to this problem has been to cover the pool when not in use. The use of a plastic sheet to cover the pool will substantially prevent evaporation of the pool water, thus saving energy and water and reducing humidity. Relatively large savings can be realized by covering the pool when not in use. The pool covers used in the past have either been manually operated, that is placed on the pool by hand, or by mechanical systems.

The manually operated systems are cumbersome to operate, particularly in larger pools. These tend to be difficult to place on the pool as well as to remove from the pool. Often more than one person may be required in order to manipulate the cover. On many occasions, the cover may be left off of the pool due to the effort needed to cover the pool, thus foregoing any savings of energy.

Mechanical systems have been designed to cover indoor pools using reels and motors. Often, these systems must be installed as the pool is being built or else use heavy portable winches which must be moved to appropriate positions. Typically, these systems require an operator to guide the cover on and off the pool to maintain the slack and prevent problems with the system. The covers often require manual adjustment of position. Also, an operator is necessary to stop and start the system when the cover is being deployed or retrieved.

A need exists for a fully reliable pool covering system that can be operated automatically and can be installed in any existing or new swimming facility.

3. Solution to the Problem

The present invention solves these and other problems by providing a fully automatic swimming pool cover that can be operated by a simple switch or preset timer without the need of intervention by an operator.

The present invention provides an automated swimming pool cover that has automatic shut-off when the pool cover is fully deployed or retrieved.

The present invention provides fail safe control to prevent equipment damage by the motor not being properly stopped at the end of cover travel.

The present invention further provides a single gear drive motor compensating for differing speeds and forces in the covering process.

The present invention also provides cover guidance to allow smooth, regular uniform and aligned winding of the cover on the reel.

The present invention also provides a design to prevent corrosion of the device.

The present invention provides a simple, economical device locating the structure in unused and inconspicuous space to reduce the expense of the device.

These features and others will become evident from the following description of one possible exemplary embodiment in conjunction with the drawings.

SUMMARY OF THE INVENTION

The present invention provides a system which deploys and retrieves a cover over a swimming pool. The cover is wound over a guide spindle onto a motor driven reel. A spool, also driven by the motor, has a tow rope wound on it. The tow rope is attached through a pulley system and secured to the cover. The tow rope pulls the cover into proper alignment over the pool.

The motor is activated by controls, such as a switch or timer, to rotate the spool to wind the tow rope onto the spool and rotate the reel to unwind the cover from the reel. Torque-limiting clutches on the reel and spool drive shafts compensate for changes in speed and forces of the winding and unwinding of the cover and the tow rope by allowing slippage of the drive shafts. Also, these clutches prevent excessive stresses from occurring if the cover or tow rope is accidentally restrained by an obstruction. A perforated ball mounted on the tow rope engages on the pulley once the front end of the cover reaches the end of the pool. This forces the spool to slip due to the torque limiting clutch while allowing the cover to further unwind until the other end of the pool is fully covered. Once the cover is in place, a photoelectric sensor stops operation of the motor.

The motor is activated in the reverse direction to retrieve the cover from the pool. The reel is rotated in the reverse direction to pull the cover over the guide spindle and onto the reel. The guide spindle aligns the cover onto the reel during the winding process.

An overriding clutch on the spool allows the spool to spin freely in one direction so the tow rope can be easily unwound from the spool by the movement of the cover without excessive stresses involved. A friction brake band provides drag on the spool to prevent slack rope from accumulating.

A photoelectric sensor detects when the cover is fully retrieved and stops the motor. Thus, no manual intervention is necessary in operating the system. A heating element is also provided within the enclosed portion of the system to raise the temperature above the dewpoint to reduce condensation and corrosion in the system. These and other features will become evident in following detailed description on a preferred embodiment in conjunction with the drawings.

BRIEF DESCRIPTION OF THE DRAWINGS

FIG. 6 is a perspective view of the cover fully deployed on the pool.

DETAILED DESCRIPTION OF A PREFERRED EMBODIMENT

The present invention provides a system for the automatic operation of a cover for an enclosed indoor swimming pool. The system allows the swimming pool to be covered by either operating a switch or through the use of a preset timer or computer. The pool is covered without the need for any manual intervention by an operator. By covering the pool, energy savings are realized since large amounts of energy, lost through the evaporation of the pool water and ventilation of the enclosed pool, are conserved. The pool, in one possible preferred exemplary embodiment, is covered, as described in detail below, by the use of a tow rope guided cover which is wound and unwound upon a reel mounted near one end of the pool.

Figure 1:
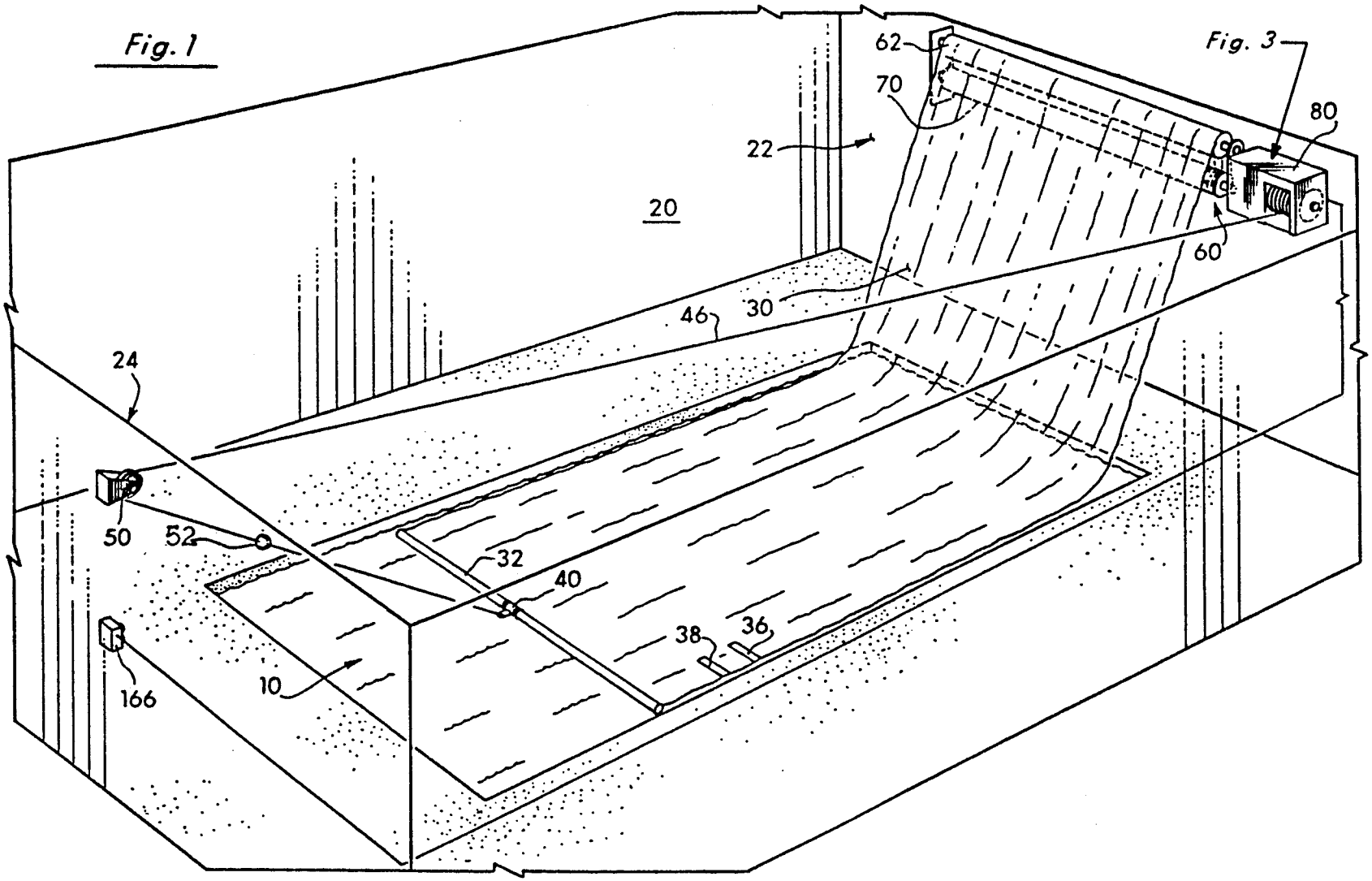
FIG. 1 is a perspective view of one possible preferred exemplary embodiment of the present invention covering an enclosed swimming pool.

One possible preferred exemplary embodiment of the present invention is shown in FIG. 1. A swimming pool 10 is housed within an enclosed structure 20 having opposing walls 22 and 24. A cover 30 is adapted to cover the entire width and length of pool 10. In the embodiment described for explanatory purposes, cover 30 extends lengthwise over pool 10. In larger pools, two or more closely adjacent covers may be used to cover the pool and may be oriented lengthwise or crosswise across the pool. Cover 30 is formed from a plastic material, such as vinyl or polyethylene, that is waterproof and will float on the surface of pool 10. Typically, air filled tubes or sacs or closed cell plastic foam strips are formed in heat sealed hems and sleeves to assist flotation of the cover. The invention is not meant to be limited by this description but includes other variations and types of covers for swimming pools or other examples that might utilize this invention.

Figure 2:
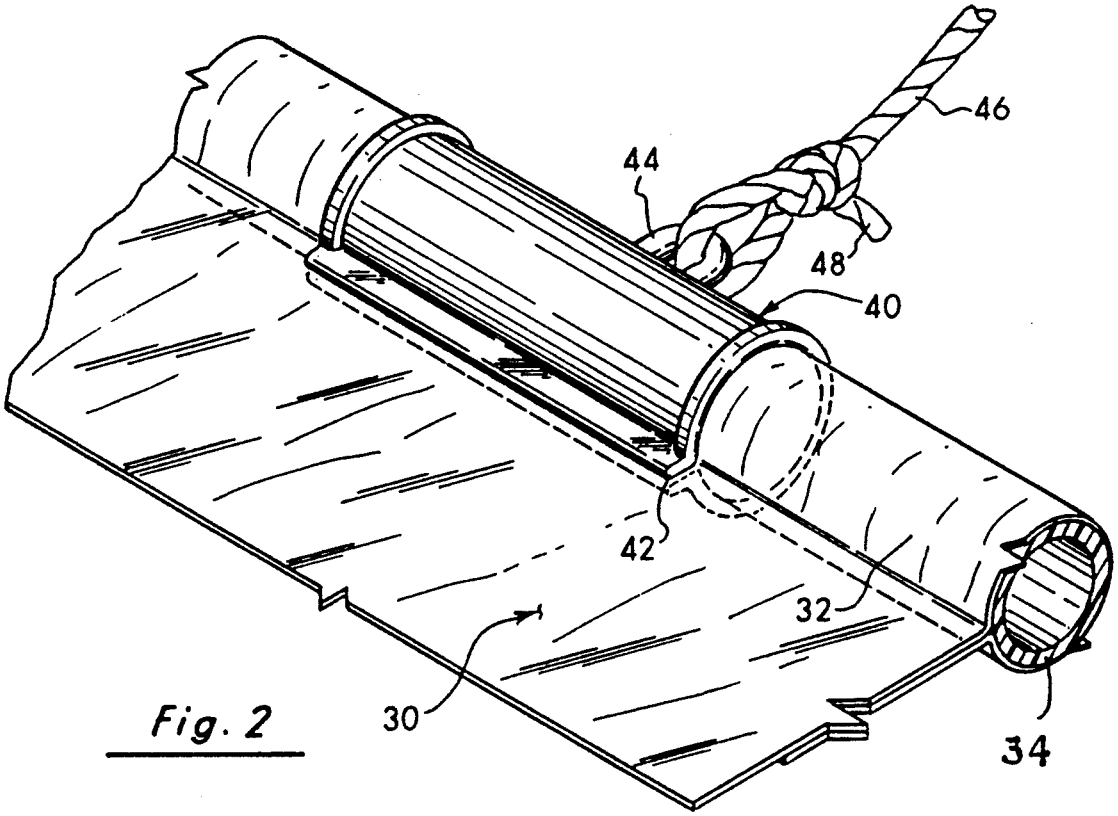
FIG. 2 is partial view of the attachment of the tow rope to the cover.

Opaque cover 30 includes a front edge 32, as shown in FIGS. 1 and 2, into which a rigid sealed, plastic tube or pipe 34 is inserted. The opposing rear edge of cover 30 is attached to a reel as discussed below. Near front edge 32 and to one side thereof, transparent windows 36 and 38 of transparent plastic are formed as illustrated in FIG. 1. The function of these windows 36, 38 is discussed fully below. An additional transparent window (not shown) is formed adjacent the rear edge of cover 30. Alternatively, cover 30 may be formed from transparent plastic and windows 36, 38, and the rear window may be formed from an opaque material.

Clip 40, shown in FIG. 2, is formed from a plastic material in a tubular design having an opening 42 extending the full length thereof. Opening 42 in clip 40 allows the clip to be mounted over one end of front edge 32 of cover 30 and slipped to a center position along front edge 32. Clip 40 includes an eyelet 44 formed on the front edge of clip 40. First end 48 of tow rope 46 is attached through eyelet 44 to clip 40 and thus to cover 30. If necessary or desired, two or more clips 40 can be mounted onto front edge 32 of cover 30 and a bridle attachment can be used to secure tow rope 46 thereto in order to balance the towing forces on cover 30. This description is for explanatory purposes only and is not meant to limit the invention. Other variations and embodiments using the inventive concept are considered to be within the scope of the claimed invention.

The opposing end of tow rope 46 is secured to a spool as discussed in detail below. Tow rope 46 extends from cover 30 up to wall 24 through a pulley 50 mounted on wall 24 to be aligned central to cover 30 as illustrated in FIG. 1. Additional pulleys can be utilized if necessary. Two pulleys (not shown) are usually used to align tow rope 46 with the spool. Plastic perforated ball 52 is fixedly mounted on tow rope 46 at a predetermined distance from cover 30. Other obstructions could be mounted on tow rope 46 in lieu of ball 52 as long as they will not pass through pulley 50.

The opposing end of tow rope 46 and the opposing end of cover 30 are attached to drive system 60 mounted on wall 22 as illustrated in FIG. 1. Drive system 60 can be located in an unused and inconspicuous space high on a wall or under the ceiling of enclosure 20.

Figure 3:
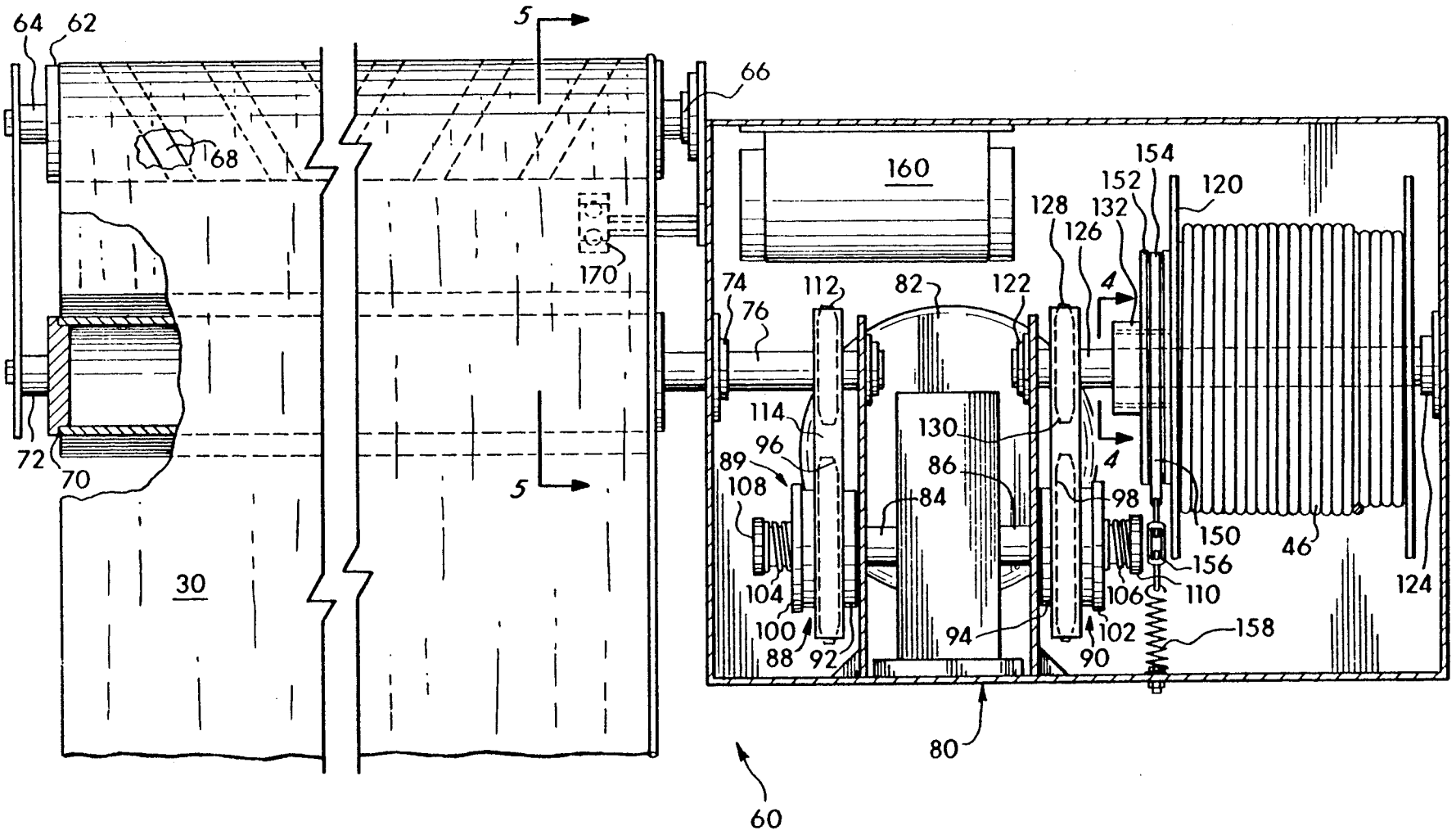
FIG. 3 is a front view of the drive mechanism of FIG. 1.

Drive system 60 includes a guide spindle 62 mounted on bearings 64, 66 to be freely rotatable as shown in FIG. 3. Guide spindle 62 is formed from an aluminum hollow tube to extend slightly longer than the width of cover 30. Friction windings 68 are attached to guide spindle 62 in a V-shape spiral fashion. The purpose of guide spindle 62 and windings 68 is discussed in detail below.

Reel 70 is rotatably mounted directly below guide spindle 62 on bearings 72, 74. Typically, reel 70 is formed from an aluminum hollow tube. Cover 30 extends over guide spindle 62 and onto reel 70 where it is securely attached. Spiral friction windings 68 and guide spindle 62 guide and align cover 30 on reel 70 to prevent cover 30 from becoming crooked or misaligned on reel 70. The space between guide spindle 62 and reel 70 also allows cover 30 to shed water therefrom.

Drive shaft 76 attached to one end of reel 70 extends into motor box 80. Reel 70 is driven by motor 82 mounted within motor box 80. Motor 82 is a gear drive motor having two output shafts 84, 86 as illustrated in FIG. 3. Each output shaft 84, 86 has a torque-limiting clutch 88, 90 mounted thereon.

Torque-limiting clutches 88, 90 include backing plates 92, 94, sprockets 96, 98, friction plates 100, 102, springs 104, 106 and adjustment knobs 108, 110. Sprockets 96, 98 are rotatable relative to drive shafts 84, 86 until engaged by resiliently biased friction plates 100, 102. Friction plates 100, 102 and backing plates 92, 94 are mounted by keys or the like to rotate with drive shafts 84, 86. The frictional engagement of sprockets 96, 98 by friction plates 100, 102 and backing plates 92, 94 force sprockets 96, 98 to rotate as drive shafts 84, 86 rotate. The sprockets are designed to slip relative to drive shafts 84, 86 when the torque on sprockets 96, 98 overcomes the frictional forces from friction plates 100, 102. The frictional forces from friction plates 100, 102 are adjustable by adjustment knobs 108, 110 to increase or decrease the spring biasing against the friction plates. The invention is not limited to the above-described clutches but encompasses other types of torque-limiting clutches known or obvious to those skilled in the art.

Sprocket 96 is operatively connected to sprocket 112 mounted on reel drive shaft 76 by chain 114. The use of torque-limiting clutch 88 prevents damage to the system should cover 30 become tangled or jammed in some way. The build-up in torque will overcome the frictional engagement of plate 100, allowing sprocket 96 to slip relative to motor drive shaft 84 until motor 82 is stopped or the entanglement straightened out.

Spool 120 is rotatably mounted within motor box 80 on bearings 122, 124. Tow rope 46 extends into motor box 80 through an opening formed in the motor box and attaches onto spool 120. Drive shaft 126 is mounted to clutch 132 to extend beyond spool 120 towards drive motor 82. Sprocket 128 is mounted onto drive shaft 126 and is operatively connected to sprocket 98 by chain 130. As discussed above, torque-limiting clutch 90 allows sprocket 98 to slip relative to motor drive shaft 86 should the torque on sprocket 98 exceed the frictional forces from clutch 90. This clutch 90 permits spool 120 to rotate at a speed no greater than necessary to retrieve tow rope 46 at the same rate that cover 30 is being released from reel 70 and to stop when motor 82 is running to prevent damage to the system should tow rope 46 become tangled.

Figure 4:
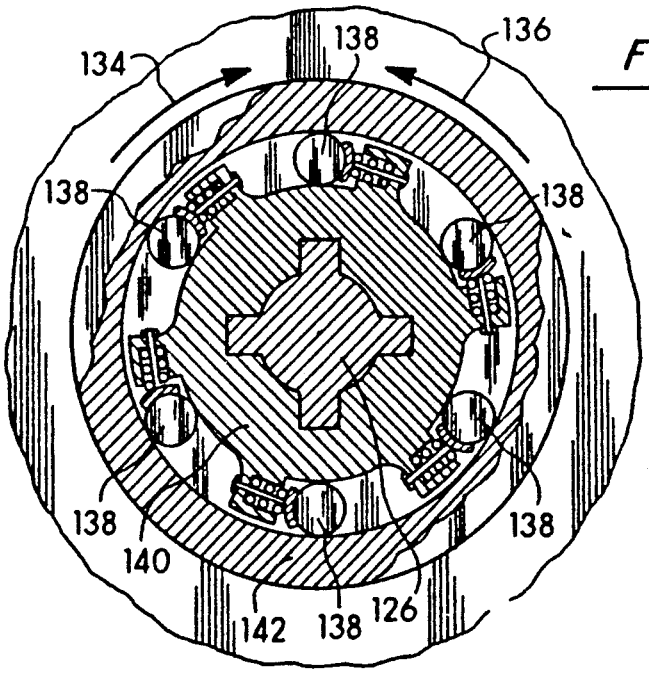
FIG. 4 is a cut away side view along lines 4—4 of FIG. 3.

Clutch 132, illustrated in FIGS. 3 and 4, is an overrunning clutch that allows spool 120 to be driven in one direction to wind tow rope 46 onto the spool, but allows spool to rotate freely relative to drive shaft 126 in the opposing direction. Typically, overrunning clutch 132 is of a type illustrated in FIG. 4. As shaft 126 is rotated in the direction of arrow 134, rollers 138 are engaged by clutch plate 140 mounted on drive shaft 126. Rollers 138 are driven by clutch plate 140 in the direction of arrow 134. Rollers 138 in this direction, engage clutch housing 142 mounted on spool 120 and drive clutch housing 142 in the direction of arrow 134, thus driving spool 120. When shaft 126 is rotated in the direction of arrow 136, rollers 138 override engagement with clutch housing 142, allowing relatively free rotation between spool 120 and drive shaft 126. Thus spool 120 is driven by motor 82 to wind tow rope 46 onto spool 120 and is allowed to disengage from being driven by motor 82 when tow rope 46 is being unwound. The invention is not meant to be limited to this particular clutch but encompasses other variations and types of clutches operable to allow spool 120 to be driven in one direction and freewheel in the opposing direction.

Brake 150 shown in FIG. 3 is attached to spool 120 to provide drag on spool 120 to prevent slack on tow rope 46 as it is being unwound. Brake 150 includes brake drum 152 secured to spool 120. Brake band 154 has one end secured to a location (not shown) inside motor box 80 and extends over brake drum 152. The opposing end of brake band 154 is secured by turnbuckle 156 and spring 158 to a location inside motor box 80. Turnbuckle 156 is adjusted until the desired drag on spool 120 is achieved due to the friction from brake band 150 on brake drum 152. In another embodiment (not shown) spring 158 and turnbuckle 156 are attached to brake band 154 and to the bottom of motor box 80 on the back side of rope spool 120 and brake drum 152. This embodiment provides more drag on rope 46 when spool 120 is releasing rope and less drag when motor 82 is driving spool 120 to retrieve rope 46.

Motor box 80 is designed to be fully enclosed except for openings for tow rope 46 and electric wires to motor 82 and heating element 160 discussed below. These openings can be sealed by grommets or the like if desired. Heating element 160 is mounted inside motor box 80. Heating element 160 is typically a 50 watt heater that is used to raise the temperature inside enclosed motor box 80 above the dew point temperature.

Figure 5:
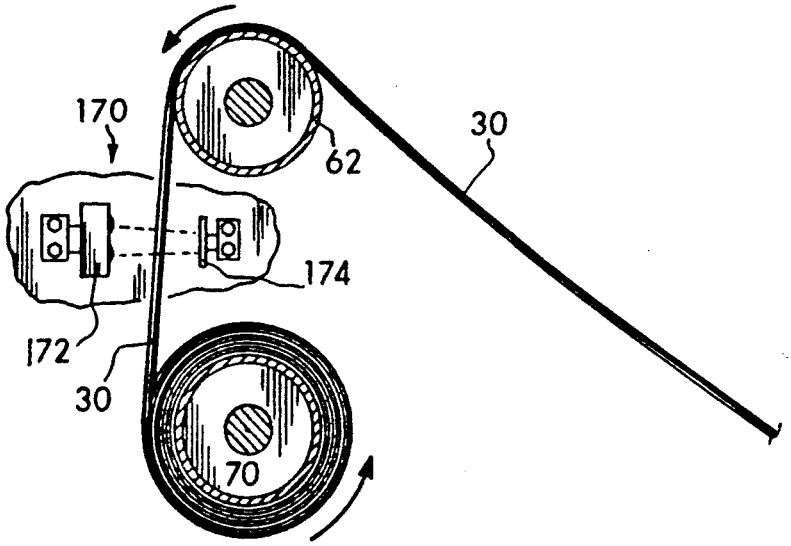
FIG. 5 is a cut away view along lines 5—5 of FIG. 3.

Switch box 166 having forward, reverse and stop buttons, is mounted at a convenient location for the operation of the system as shown in FIG. 1. Motor 80 is connected to switch box 166, timer (not shown), computer (not shown) or other control mechanism to control the system operation. Photoelectric sensor 170 shown in FIGS. 3 and 5 is mounted on motor box 80 adjacent reel 70. Typically, photoelectric sensor 170 is mounted so that cover 30 passes between an emitter 172 and a receiver 174. Cover 30 interrupts the beam between emitter 172 and receiver 174 except when the transparent windows formed in cover 30 pass between emitter 172 and receiver 174. The windows are located in cover 30 so that as cover 30 is fully deployed, the window at the rear of cover 30 passes between emitter 172 and receiver 174. Photoelectric sensor 170 then interrupts the motor control circuit to stop drive motor 82. As cover 30 is fully removed from pool 10, window 36 passes between emitter 172 and receiver 174. Photoelectric sensor 170 then interrupts the motor control circuit to stop drive motor 82. This allows cover 30 to be automatically deployed and removed without the need for manual intervention or supervision. Transparent window 38 is located near window 36 to shut motor 82 off if the removal control is operated when cover 30 is already fully wound onto reel 70. This prevents damage to the system due to accidental activation of the wrong switch. Other types and variations of photoelectric sensors are usable under the inventive concept. The above description is meant for explanatory purposes only.

OPERATION

Cover 30 is initially deployed by activation of motor 82, either by operating switch box 166 or by other control means such as a preset timer. Should motor 82 be accidently activated in the removal mode, window 38 will pass through photoelectric sensor 170 which will stop motor 82 before damage can occur to the system. When motor 82 is properly activated, drive shafts 84, 86 are rotated so that reel 70 begins unwinding cover 30 and spool 120 begins winding tow rope 46.

Sprockets 96, 98, 112 and 128 are chosen so that reel 70 and spool 120 rotate at speeds balanced to keep sufficient tension in tow rope 46 to pull cover 30 without excessive stress on cover 30. If stress in cover 30 or in tow rope 46 becomes excessive, torque-limiting clutch 90 will allow sprocket 98 to slip. This prevents damage to cover 30 or the system in general and permits spool 120 to operate at a rate sufficient to apply proper force to tow rope 46 to move cover across pool and permits spool 120 to be stationary when deployment of cover 30 is being completed. Also torque-limiting clutch 90 will allow sprocket 98 to slip should tow rope 46 or cover 30 become entangled.

The diameters of cover 30 on reel 70 and tow rope 46 on spool 120 are continuously changing during operation of the system. This creates changes in the speeds of cover 30 coming off reel 70 and tow rope 46 winding onto spool 120. Torque-limiting clutches 88, 90 allow the system to compensate by allowing slippage of either sprocket 96, 98 when the variations in speed creates excessive torques in either cover 30 or tow rope 46.

Ball 52 engages pulley 50 when front edge 32 of cover 30 reaches the end of pool 10. This causes a torque on clutch 90 so that spool 120 will no longer rotate. Reel 70 continues to unwind cover 30 until the rear of pool 10 is fully covered. Once cover 30 is fully deployed to cover pool 10, the transparent window near the rear edge of cover 30 will pass by photoelectric sensor 170 causing the sensor to stop motor 80. A stop switch is also provided to stop motor 82 at any time as an emergency precaution.

Cover 30 is removed from pool 10 by activating motor 82 to rotate in the reverse direction, either by switch 166 or by other control means. The rotation of motor 82 in the reverse direction rotates drive shafts 84, 86 to cause reel 70 to wind cover 30 about reel 70.

Cover 30 goes over guide spindle 62 prior to winding about reel 70. Spiral friction windings 68 align cover 30 onto reel 70 by the forces generated by cover 30 being pulled across the spiraling windings. Cover 30 is guided by these forces in a lateral direction. Torque-limiting clutch 88 allows sprocket 96 to slip if the stresses on cover 30 exceed an allowable amount.

Shaft 86 rotatably drives shaft 126 but clutch 132 overrides shaft 126 as tow rope 46 is unwound from spool 120 during movement of cover 30. The freewheeling action of spool 120 allows sufficient amount of tow rope 46 to be unwound while preventing tension from tow rope 46 stressing cover 30. Brake band 154 provides drag on spool 120 to prevent slack in tow rope 46 during retrieval of cover 30.

Once cover 30 is fully retrieved, transparent window 36 passes by photoelectric sensor 170, causing sensor 170 to stop motor 82. Thus manual intervention of the system is not necessary during the operation of the system.

Most of the corrosion-sensitive elements of the system are located within the enclosed motor box 80. Heating element 160 inside motor box 80 keeps the temperature above the dew point to prevent humidity and moisture buildup within the box. This helps to prevent condensation and corrosion in the system.

The present invention provides a system that will safely and conveniently automatically cover and uncover a swimming pool. No manual intervention is necessary with the present invention. The present system has durable and reliable operation without constant maintenance or supervision. The system can be built onto new pools or fitted to existing pools. The system can be mounted in an out of the way location so to be unobtrusive. These and other features are readily performed by the system of the present invention.

The claimed invention is not meant to be limited by the above description of one possible exemplary embodiment. Other variations and embodiments are considered to be within the range and scope of the inventive concept.

We claim:

1. A system for deploying and retrieving a cover for a swimming pool, said system comprising:

a cover for covering a swimming pool;

a reel mounted for rotation near a first end of said pool, said cover having one end attached to said reel;

a tow rope having one end attached to a free edge of said cover and a second end attached to a rotatable spool;

drive means operatively connected to said reel and to said spool for simultaneously rotating said reel and spool in a first direction to unwind said cover at a controlled rate from said reel to deploy said cover over said pool and to wind said tow rope onto said spool to tow said cover over said pool; and for rotating said reel in a second direction to wind said cover onto said reel to remove said cover from said pool;

first torque-limiting clutch means mounted between said drive means and said reel for permitting said reel to slip relative to said drive means only when the tension in said cover exceeds a predetermined limit during the retrieval of said cover to prevent damage to said system; and means for automatically operating said system.

2. The system of claim 1 wherein said drive means comprise a bi-directional rotating gear drive motor.

3. The system of claim 1 wherein said compensating means includes:

second torque-limiting clutch means mounted between said drive means and said spool to permit said spool to slip relative to said drive means when the tension in said rope exceeds a predetermined limit to prevent damage to said system.

4. The system of claim 3 wherein said system includes:

said clutch means are operatively connected to said drive means and said spool for said drive means to rotatably drive said spool in said first direction to wind said tow rope onto said spool and disengaging said spool from said drive means as said drive means rotates in said second direction to wind said cover onto said reel to allow said tow rope to unwind from said spool.

5. The system of claim 4 wherein said second clutch means includes an overrunning clutch.

6. The system of claim 4 wherein said tow rope winding means further includes:

means for providing sufficient drag on said tow rope as said tow rope is unwinding to prevent a slack rope during cover retrieval.

7. The system of claim 6 wherein said drag means include a brake band resiliently biased against said spool.

8. The system of claim 1 wherein said system further comprises means for aligning said cover on said reel.

9. The system of claim 1 wherein said means for automatically operating said system includes:

means for automatically stopping said drive means when said cover is properly positioned on said pool and when said cover is fully removed from said pool.

10. The system of claim 1 wherein said system further comprises means for resisting corrosion within corrosion-sensitive elements of said system.

11. A system for deploying and retrieving a cover for a swimming pool, said system comprising:

a cover for covering a swimming pool;

a reel mounted for rotation near a first end of said pool, said cover having one end attached to said reel;

a tow rope having one end attached to a free edge of said cover and a second end attached to a rotatable spool;

drive means operatively connected to said reel and to said spool for simultaneously rotating said reel and spool in a first direction to deploy said cover over said pool and for rotating said reel in a second direction to wind said cover onto said reel to remove said cover from said pool;

a guide spindle rotatably mounted above said reel; and friction means mounted in opposing spirals on each end of said guide spindle to force the side edges of said cover towards each end of said guide spindle for horizontally guiding said cover into proper centering alignment onto said reel and for spreading said cover horizontally to reduce wrinkling of said cover on said reel.

12. A system for deploying and retrieving a cover for a swimming pool, said system comprising:

a cover adapted to cover a swimming pool;

a reel mounted for rotation near a first end of said pool, said cover having one end attached to said reel;

a tow rope having one end attached to a free edge of said cover and a second end attached to a rotatable spool;

drive means operatively connected to said reel and to said spool for rotating said reel and spool;

in a first direction to unwind said cover from said reel to deploy said cover over said pool and wind said tow rope onto said spool to guide said cover over said pool; and in a second direction to wind said cover onto said reel to remove said cover from said pool;

means for obstructing said tow rope when said cover reaches one end of said pool to stop said tow rope from further pulling said cover while said cover continues to be unwound from said reel;

transparent windows formed at predetermined points in said cover; and photoelectric sensors operatively connected to said drive means and positioned to transmit through said windows when said cover is in the proper position on said pool and when said cover is off said pool to stop said drive means.

13. The system of claim 12 wherein said automatic stopping means further includes:

an additional window formed in said cover at a predetermined location so that said photoelectric sensor will transmit through said additional window should said drive means be operated to wind said cover onto said reel when said cover is already fully wound onto said reel.

14. A system for deploying and retrieving a cover for a swimming pool, said system comprising:

a cover for covering a swimming pool;

a reel mounted for rotation near a first end of said pool, said cover having one end attached to said reel;

a tow rope having one end attached to a free edge of said cover and a second end attached to a rotatable spool;

drive means operatively connected to said reel and to said spool for simultaneously rotating said reel and spool in a first direction to deploy said cover over said pool and for rotating said reel in a second direction to wind said cover onto said reel to remove said cover from said pool;

an enclosure for mounting substantially all corrosion-sensitive elements of said system; and a heating element within said enclosure to raise the surface temperature of said elements within said enclosure above the dew point of the environment to prevent condensation on said elements.

15. A system for automatic operation for covering a swimming pool, said system comprising:

a reel mounted for rotation near a first end of a pool, a cover for covering said swimming pool and having one end attached to said reel;

a tow rope having one end attached to a free edge of said cover and a second end attached to a rotatable spool;

drive means operatively connected to said reel for rotating said reel in a first direction to unwind said cover from said reel to deploy said cover over said pool and in a second direction to wind said cover onto said reel to remove said cover from said pool;

said drive means operatively connected to said spool for rotating said spool in a first direction as said reel is rotated in said first direction to wind said rope onto said spool as said cover is being deployed; and means for stopping said tow rope from winding onto said spool while said drive means continues to rotate said reel in said first direction to continue to unwind said cover to fully deploy said cover over said pool.

16. The system of claim 15 wherein said tow rope stopping means includes:

a torque-limiting clutch mounted between said drive means and said spool to permit said spool to slip relative to said drive means when the tension in said rope exceeds a predetermined limit to prevent damage to said system; and means mounted on said tow rope for obstructing said tow rope when the front edge of said cover reaches one end of said pool so the tension in said rope exceeds said predetermined limit to prevent said tow rope from further pulling said cover as said cover continues to be unwound to cover the other end of said pool.

17. The system of claim 16 wherein said system further comprises:

a torque-limiting clutch mounted between said drive means and said reel to permit said reel to slip relative to said drive means when the tension in said cover exceeds a predetermined limit to prevent damage to said system.

18. The system of claim 17 wherein said system further includes:

means for providing sufficient drag on said spool as said tow rope is unwinding to prevent a slack rope during cover retrieval.

19. The system of claim 18 wherein said system further comprises means for aligning said cover on said reel.

20. The system of claim 19 wherein said aligning means includes:

a guide spindle rotatably mounted above said reel; and friction windings mounted in opposing spirals on the ends of said guide spindle so that said cover is guided by said friction windings into proper alignment onto said reel.

21. The system of claim 20 wherein said system further includes:

an additional window formed in said cover at a predetermined location so that said photoelectric sensor will transmit through said additional window should said drive means be operated to wind said cover onto said reel when said cover is already fully wound onto said reel.

22. The system of claim 21 wherein said system further comprises means to resist corrosion within corrosion-sensitive elements of said system.

23. The system of claim 22 wherein said corrosion-resistant means include an enclosure for mounting said corrosion-sensitive elements of said system; and a heating element within said enclosure to raise the temperature within said enclosure above the dew point of the environment.

24. The system of claim 15 wherein said system further comprises:

transparent windows formed at predetermined points in said cover;

photoelectric sensors operatively connected to said drive means; and said photoelectric sensors positioned to transmit through said windows when said cover is in the proper position on said pool and when said cover is fully retrieved from said pool to stop said drive means.

25. A method for automatically deploying and retrieving a cover over a swimming pool, said cover having a tow rope attached to one end to tow said cover as said cover is deployed and a rotatably driven reel to wind and unwind said cover as said cover is retrieved and deployed on said pool, said method comprising the steps of:

activating a single drive means operatively connected to said reel and to a spool for simultaneously rotating said reel in a first direction to unwind said cover and for rotating said spool in a first direction to wind said tow rope onto said spool to deploy said cover over said pool;

automatically stopping said drive means when said cover is fully deployed;

activating said drive means in a second direction to wind said cover onto said reel to retrieve said cover from said pool;

providing means for disengaging said spool from said drive means as said drive means is operated in a second direction to wind said cover onto said reel;

providing means for allowing said reel to slip relative to said drive means only when the tension in said cover exceeds a predetermined limit during the retrieval of said cover to prevent damage to said system; and automatically stopping said drive means when said cover is fully retrieved.

26. The method of claim 25 wherein said step of automatically stopping said drive means further includes:

sensing when said drive means is activated to retrieve said cover when said cover is already fully retrieved; and stopping said drive means in response to said sensing means.

27. The method of claim 25 wherein said method further includes the step of:

allowing said spool to freely rotate relative to said drive means when said drive means operates in said second direction to permit unwinding of said tow rope as it is pulled from said spool as said cover is wound onto said reel.

28. The method of claim 25 wherein said method further comprises the step of:

raising the temperature around the corrosion-sensitive elements of the system above the dew point temperature to prevent condensation and corrosion on said elements.

29. A method for automatically deploying and retrieving a cover over a swimming pool, said cover having a tow rope attached to one end of said cover to tow said cover as said cover is deployed and a rotatably driven reel to wind and unwind said cover as said cover is retrieved and deployed on said pool, said method comprising the steps of:

activating a single drive means operatively connected to said reel and to a spool for simultaneously rotating said reel in a first direction to unwind said cover and for rotating said spool in a first direction to wind said tow rope onto said spool to deploy said cover over said pool;

sensing when said cover si fully deployed and fully retrieved by transparent windows formed in said cover passing by photoelectric sensors;

providing an obstruction on said tow rope when the first end of said cover reaches the end of said pool to prevent said tow rope from further pulling said cover while said cover continues to be unwound from said reel to fully cover the other end of said pool;

stopping said drive means in response to said sensing means when said cover is fully deployed;

activating said drive means in a second direction to wind said cover onto said reel to retrieve said cover from said pool;

operatively disconnecting said spool from said drive means to permit said tow rope to unwind from said spool as said cover is wound onto said reel;

providing means for allowing said reel to slip relative to said drive means only when the tension in said cover exceeds a predetermined limit during the retrieval of said cover to prevent damage to said system;

sensing when said cover is fully retrieved by transparent windows formed in said cover passing by photoelectric sensors; and stopping said drive means in response to said sensing means when said cover is fully retrieved.

30. A system for deploying and retrieving a cover for a swimming pool, said system comprising:

a cover having a first end and an opposing second end for covering at least a portion of a swimming pool;

a rotatable reel mounted above said pool and near a first end of said pool, said first end of said cover attached to said reel;

a tow rope having one end attached to said second end of said cover and a second end attached to a rotatable spool;

drive means operatively connected to said reel and to said spool for simultaneously rotating said reel and said spool in a first direction to unwind said cover from said reel to deploy said cover over said pool and to wind said tow rope onto said spool to tow said cover over said pool; and for rotating said reel in a second direction to wind said cover onto said reel to remove said cover from said pool and for operatively disconnecting from said spool to allow said tow rope to freely unwind from said spool;

means for allowing said reel to slip relative to said drive means only when the tension in said cover reaches a predetermined level to prevent damage to said cover; and means for allowing said spool to slip relative to said drive means during deployment of said cover when the tension in said tow rope reaches a predetermined level to permit winding of said tow rope onto said spool at a rate equal to the horizontal rate of movement of said second end of said cover.

31. A system for deploying and retrieving a cover for a swimming pool, said system comprising:

a cover adapted to cover a swimming pool;

a reel mounted for rotation near a first end of said pool, said cover having one end attached to said reel;

a tow rope having one end attached to a free edge of said cover and a second end attached to a rotatable spool;

drive means operatively connected to said reel and to said spool for simultaneously rotating said reel and spool in a first direction to unwind said cover at a controlled rate from said reel to deploy said cover over said pool and to wind said tow rope onto said spool to tow said cover over said pool; and for rotating said reel in a second direction to wind said cover onto said reel to remove said cover from said pool; and means for driving said spool and said reel at differing rotational speeds to compensate for differing diameters of said tow rope on said spool and of said cover on said reel as said tow rope is wound onto said spool and said cover is deployed over said pool.

32. The system of claim 31 wherein said means for driving said spool and said reel at differing rotational speeds includes:

torque limiting clutch means operatively connecting said drive means and said spool for permitting said spool to slip relative to said drive means when the tension in said rope exceeds a predetermined limit.

33. The system of claim 32 wherein said system further includes:

clutch means operatively connecting said drive means and said spool for rotationally driving said spool in said first direction to wind said tow rope onto said spool and disengaging said spool from said drive means as said drive means rotates in a second direction to wind said cover onto said reel while allowing said tow rope to unwind from said spool.

34. The system of claim 32 wherein said system further includes:

torque-limiting clutch means mounted between said drive means and said reel for permitting said reel to slip relative to said drive means when the tension in said cover exceeds a predetermined limit during the retrieval of said cover to prevent damage to the system.

* * * * *